US008882381B2

(12) United States Patent
Nobles

(10) Patent No.: US 8,882,381 B2
(45) Date of Patent: Nov. 11, 2014

(54) CASE FOR COSMETICS OR OTHER PRODUCTS

(76) Inventor: Brigitte Donna Nobles, Durham, NC (US)

( * ) Notice: Subject to any disclaimer, the term of this patent is extended or adjusted under 35 U.S.C. 154(b) by 372 days.

(21) Appl. No.: 13/122,018

(22) PCT Filed: Oct. 2, 2009

(86) PCT No.: PCT/US2009/059400

§ 371 (c)(1),
(2), (4) Date: Mar. 31, 2011

(87) PCT Pub. No.: WO2010/040067

PCT Pub. Date: Apr. 8, 2010

(65) Prior Publication Data

US 2011/0176854 A1 Jul. 21, 2011

Related U.S. Application Data

(60) Provisional application No. 61/102,476, filed on Oct. 3, 2008.

(51) Int. Cl.

| | |
|---|---|
| ***A46B 11/00*** | (2006.01) |
| ***A46B 5/00*** | (2006.01) |
| ***A45D 40/26*** | (2006.01) |
| *A45D 34/00* | (2006.01) |

(52) U.S. Cl.

CPC ..... *A45D 40/265* (2013.01); *A46B 2200/1053* (2013.01); *A46B 5/0095* (2013.01); *A45D 2200/052* (2013.01); *A45D 2034/005* (2013.01)

USPC ..... 401/129; 401/126

(58) Field of Classification Search

USPC ..... 401/121, 122, 126–130, 194

See application file for complete search history.

(56) References Cited

U.S. PATENT DOCUMENTS

| | | | | |
|---|---|---|---|---|
| 4,921,366 | A * | 5/1990 | Hurrell | 401/126 |
| 6,343,887 | B1 | 2/2002 | Dumler et al. | |
| 6,523,548 | B2 * | 2/2003 | Bouix et al. | 132/218 |
| 2003/0075199 | A1 | 4/2003 | Bertazza et al. | |

FOREIGN PATENT DOCUMENTS

| | | |
|---|---|---|
| KR | 20-0338767 | 1/2004 |

OTHER PUBLICATIONS

The International Bureau of WIPO, International Preliminary Report on Patentability and Written Opinion of the International Searching Authority for International Application No. PCT/US2009/059400 dated Apr. 5, 2011.

* cited by examiner

*Primary Examiner* — David Walczak

(74) *Attorney, Agent, or Firm* — Andrew D. Gerschutz; John E. Slaughter, III; Moore & Van Allen, PLLC

(57) ABSTRACT

A container or case for cosmetics or other products that are applied by an applicator tool, the container or case comprising a housing adapted to receive an exchangeable cartridge and a handle adapted to receive an exchangeable applicator tool. In some embodiments, the housing comprises a window for viewing the substance contained in the exchangeable cartridge.

17 Claims, 5 Drawing Sheets

CASE FOR COSMETICS OR OTHER PRODUCTS

CROSS-REFERENCE TO RELATED APPLICATIONS

This application is filed under the provisions of 35 U.S.C. §371 and claims the benefit of International Patent Application No. PCT/US2009/059400, filed on Oct. 2, 2009, entitled "Case for Cosmetics or Other Products" in the name of Brigitte Donna Nobles, which claims priority of Provisional Patent Application No. 61/102,476, filed on Oct. 3, 2008, both of which are hereby incorporated by reference herein in their entirety.

TECHNICAL FIELD

The present invention is a case for cosmetics or other products in liquid, paste, gel, powder, granular, or other form, such as mascara; paint; glue; lotion; polish; lip gloss or other make-up; a medical cream, liquid, or ointment; household product; or other industrial substance, to be applied with an appropriate tool, such as a brush, sponge, comb or other applicator tool, based on the content of the case and the object to which the content is to be applied, such as parts of the body.

BACKGROUND ART

Many products such as mascara are packaged in cases which are used and then entirely disposed of and which lack replaceable components. The disposal of the entire case results in environmental waste. Additionally, this inhibits replacement of components such as an applicator tool which may get contaminated or otherwise become worn or unusable, which would minimize waste if the applicator tool were easily replaceable since the remaining components could continue to be used and only the applicator tool would be disposed of. Further, the products are usually deposited directly within the case, rather than in a replaceable cartridge within the case, which inhibits use of different products within the case, inhibits reuse of the case, and promotes disposal of the case and overall waste rather than retention of the case. Finally, because products currently are packaged in the aforesaid manner, such packaging does not promote use of durable, valuable, and/or aesthetically-enhanced materials for the case itself.

SUMMARY OF THE INVENTION

The present invention is intended to overcome the aforesaid drawbacks. Embodiments of the present invention provide a case for a substance that is applied by an applicator tool, comprising a housing adapted to receive an exchangeable cartridge with a cavity for use in containing a substance, and a handle adapted to receive an exchangeable applicator tool with an applicator end for use in applying the substance. In some embodiments, the housing comprises a window for viewing the cavity of the exchangeable cartridge.

Embodiments of the present invention provide a method of replacing an exchangeable applicator tool in a case for a substance, comprising providing a case comprising: a housing adapted to receive an exchangeable cartridge and a handle adapted to receive an exchangeable applicator tool, wherein the housing and the handle are removably attached when the case is in a closed position; an exchangeable cartridge removably attached to the housing; and an exchangeable applicator tool removably attached to the handle; removing the exchangeable applicator tool from the handle; and removably attaching a second exchangeable applicator tool to the handle.

Embodiments of the present invention provide method of replacing an exchangeable cartridge in a case for a substance, comprising: providing a case comprising: a housing adapted to receive an exchangeable cartridge and a handle adapted to receive an exchangeable applicator tool, wherein the housing and the handle are removably attached when the case is in a closed position; an exchangeable cartridge removably attached to the housing; and an exchangeable applicator tool removably attached to the handle; removing the exchangeable cartridge from the housing; and removably attaching the second exchangeable cartridge to the housing.

Embodiments of the present invention provide a method of manufacturing a case for containing a substance that is applied by an applicator tool, comprising providing a housing adapted to receive an exchangeable cartridge with a cavity for use in containing a substance; providing a handle adapted to receive an exchangeable applicator tool with an applicator end for use in applying the substance; and providing connectors for removably attaching the housing and the handle so that the applicator end of the exchangeable applicator tool is inserted in the cavity of the exchangeable cartridge when the case is in a closed position.

Embodiments of the present invention provide an exchangeable cartridge for use in a case, comprising an exchangeable cartridge with a cavity for use in containing a substance and at least partly constructed of a transparent or translucent material, wherein the exchangeable cartridge is adapted for removable insertion into a case. In at least some embodiments, the case comprises a window for viewing the cavity of the exchangeable cartridge. In at least some embodiments, the mouth or top of the exchangeable cartridge has a seal and/or a cover.

Embodiments of the present invention provide an exchangeable applicator tool for use in a case, comprising an exchangeable applicator tool with an applicator end for use in applying a substance and constructed of a washable material, wherein the exchangeable applicator tool is adapted for removably attaching to a case.

DETAILED DESCRIPTION

Figure 1:
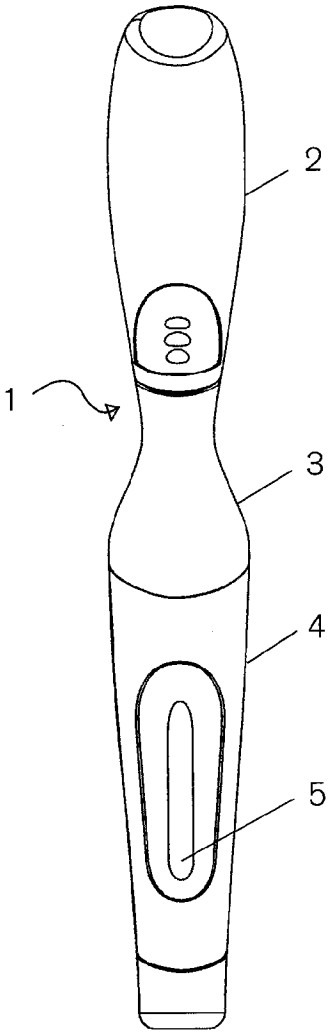
FIG. 1 shows a view of one embodiment of the invention when fully assembled and closed.

The present invention will now be described in terms of specific, example embodiments. It is to be understood that the invention is not limited to the example embodiments disclosed. It should also be understood that not every feature of the methods described is necessary to implement the invention as claimed in any particular one of the appended claims. Various elements and features of various embodiments are described in order to fully enable the invention.

Embodiments of the present invention provide a case for a substance that is applied by an applicator tool, comprising a housing adapted to receive an exchangeable cartridge (also referred to herein as a "cartridge"), and a handle adapted to receive an exchangeable applicator tool (also referred to herein as an "applicator tool"), wherein the applicator tool has an applicator end that is in direct contact with the substance being applied.

In some embodiments, the housing comprises a window for viewing the substance contained in the exchangeable cartridge. In at least some embodiments, the case is of a size that is convenient for a user to carry on their person, such as a small size that would fit within a woman's purse. In at least some embodiments, the case is attractive and is presented as a fashion accessory.

The case is shaped to contain a cartridge and an applicator tool, both of which are removably attached to the case. The applicator tool is replaceable, avoiding waste of the entire case when the applicator tool warrants replacement or when a different type of applicator tool is needed. The cartridge is replaceable, meaning it can be removed and/or exchanged with another cartridge, thus reducing waste (as compared with disposing of the entire case when the user is finished with the content of the cartridge) and enabling reuse of the case. In some embodiments, the cartridge is refillable and/or recyclable, enabling re-use and reducing waste for still further.

The case may be manufactured from a range of materials, from plastic to durable and/or valuable and aesthetically-pleasing materials such as gold, stainless steel, platinum, etc. (and even decorated in other fashions, such as gem-encrusted or appealing designs), to give attractive looks that promote retention rather than disposal and to provide a fashion product, similar to jewelry, watches, purses, shoes, etc. Then, the case comprising a housing and a handle will not be disposed and thus will not create waste.

Embodiments of the present invention provide a system in which a user can select a type of exchangeable applicator tool to carry in the case and a substance to carry in the case based on the choice of exchangeable cartridges and the substances contained therein. In one example, a user may select an exchangeable cartridge containing mascara, and may select an exchangeable applicator tool with an applicator end that is a curved mascara brush. In another example, a user may select an exchangeable cartridge containing lip gloss, and may select an exchangeable applicator tool with an applicator end that is a sponge with a tapered tip. In still another example, a user may select an exchangeable cartridge containing a temporary hair dye, and may select an exchangeable applicator tool with an applicator end that is a comb. In yet another example, a user may select an exchangeable cartridge containing a nail polish, and may select an exchangeable applicator tool with an applicator end that is a nail polish brush. In still another example, a user may select an exchangeable cartridge containing a medical cream, and may select an exchangeable applicator tool with an applicator end that is sterile and is appropriate for applying the cream, for instance perhaps the tool is shaped like a cotton swab. For embodiments of the invention used for medical purposes or other purposes requiring sterility, the exchangeable applicator tool may be a sterile, single-use tool with an applicator end such as a pad, a cotton swab, or a sponge. It is understood that any combination of exchangeable cartridge and exchangeable applicator tool may be selected by the user, and such combination still falls within the scope of the invention.

The case and system for use as described herein provides a versatile and functional accessory. The exchangeable cartridges to be used in the system are provided with a cover or a seal, so that the cartridges can be covered for protection of the substance within the cartridge and for storage when the cartridge is not in the case. In at least some embodiments, the exchangeable applicator tools used in the system are washable, so that they can either be wiped off, washed, or otherwise cleaned when a cartridge is exchanged, or can simply be cleaned and stored when not in the case. In some embodiments, the exchangeable applicator tools are single-use tools. In some embodiments, the exchangeable applicator tools are sterile, single-use tools.

The applicator tool may be attached in a variety of ways to the handle of the case, including, for example, with a screw means such that the screw means may screw the applicator tool into the handle and/or may screw the handle into place on the case. In some embodiments, the applicator tool may snap into place in the handle such as by an elastic interference between the protruding edge on the handle of the case and a recess in the case (or vice versa), or the end of the applicator tool opposite the applicator end may fit through an opening within the handle such that the entire applicator tool may not fit through the gap and is otherwise restricted from movement, or by other means, such that the applicator tool is fixed into place for use but is readily removable from the case itself. The applicator tool typically will fit within any cartridge present when the case is closed, but depending on the embodiment, may vary.

The ability to use different types of applicator tools also allows the user to select a preferred or optimal applicator tool, e.g., one's personal preference may vary with which sort of brush one uses for mascara, rather than using a preselected one as must be done with a typical product case. Because the cartridge is replaceable, this also allows replacement of just the applicator tool not only when worn or when a different applicator tool is preferred for use, but also if an applicator tool otherwise becomes undesirable to use or unusable such as caked with content from the cartridge. A further advantage is obtained when the applicator tool is made of a washable material so that it can be kept clean and sanitary for use.

In some embodiments, the applicator tool may be further stabilized within the case by use of a skirt in the structure of the case. In some embodiments, the skirt may serve to assist in holding the applicator tool in place for fine control of the applicator tool when applying the substance stored in the case. In some embodiments, the skirt may be added for aesthetic purposes. In some embodiments, the handle and the skirt comprise two separate components of the case. In some embodiments, the handle and the skirt are integrated into a single component of the case and are referred to as a handle.

The cartridge may be attached in a variety of ways to the case, including with screw threads on at least part of the exterior to fit within a screw thread recess on the inside of the case (or vice versa), or inserted within the housing with the case end being able to close (e.g., via a separate screwing piece, an end which snaps closed, etc.). The case is typically designed so that the cartridge is physically restricted from further movement within the case once it is fixed in place.

The cartridge may be provided with a covering over the mouth opening to protect the substance within, prior to use or between uses. For example, the cartridge may have a removable and replaceable lid that fits over the mouth of the cartridge, or may have a mouth which has a seal that is pierced by the applicator tool once the case and its components are fully assembled and closed. There are many different methods for providing a covering for the cartridge, and how the cartridge is covered is not meant to be a limitation of the present invention. In some embodiments, the cartridge may have both a factory seal and a removable cover. The factory seal may serve to inform the user that the contents within the cartridge are clean and unused. The replaceable cover may be used by the user for storage of the cartridge and protection of the contents when the cartridge has been removed from the case and is being stored while a different cartridge is placed in the case. In at least some embodiments, the replaceable cover is not used while the cartridge is being used within the case. Rather, it is only used for storage of the cartridge outside of the case.

The cartridge is easily removed and replaced. In at least some embodiments, the cartridge is inserted and removed through an opening at the bottom of the housing. Connecting means, such as a screw means, a twist-lock means, and/or a snap-lock means, holds the cartridge in place inside the housing. In some embodiments, there is a bottom connector that fits over an opening in the bottom of the housing into which the cartridge is inserted.

In some embodiments, the cartridge may be inserted into an opening at the top of the housing, at the end of the housing that removably attaches to the handle. In some embodiments, the housing may have a clamshell-like opening, thereby opening on the long axis by a hinged mechanism.

When the cartridge is placed into the housing of the case, in at least some embodiments, the edge of the mouth of the cartridge is flush, or even, with the edge of the housing of the case, such that when the applicator tool is inserted into the cartridge, it does not leave residue either on the housing (for example, if the mouth was further recessed within the case) or on the cartridge (for example, if the mouth extended further out from the section of the case substantially containing the cartridge). In other words, in some embodiments, when the cartridge is fully inserted and removably attached to the housing, the upper defining edge of the cartridge is flush with the upper defining edge of the housing. The cartridges of the invention are meant to be exchangeable and replaceable in the case in a way that is functional, so that the contents of a first cartridge used in the case do not contaminate the contents of a second cartridge placed in the case after the first cartridge is removed.

Ideally the cartridge is clear to show the contents within, and the case has at least a clear window or an opening by which to view the cartridge contents when the entire case is assembled and closed, which enables knowing what substance is within, how much content is left, and when to replace a cartridge in which there is only a small quantity of substance left. Because the cartridge is replaceable, this also allows replacement of just the cartridge not only when the amount of substance is low or when a different cartridge is preferred for use, but also if a cartridge's contents otherwise become undesirable to use or unusable such as dried out or unsanitary.

The outer housing of the case, or container, may be comprised of several parts which fasten together (whether by screwing, snapping, or other attaching means that can be repeatedly performed) when fully assembled, or may be designed in other ways, such as a single piece which opens in a clamshell fashion (along the long axis) within which are secured the cartridge and applicator tool, or with a "pop-out" mechanism like a pen but which separates the outer case into a first section adapted to retain a cartridge and a second section adapted to retain an applicator tool, or otherwise. In some embodiments, the connecting mechanism may be a twist-lock mechanism that is activated by placing the two pieces to be connected together, and then rotating one of the pieces 90° to fit together a protrusion that locks into an opening made to receive the protrusion.

With reference to the figures, the following description is based on an exemplary implementation of an embodiment of the invention. In FIG. 1, the container or case 1 is depicted as fully assembled and closed, thus showing the outer components of the case. The handle 2 is removably attached to the housing 4. The handle 2 and the housing 4 can be removable attached by any suitable mechanical connection. One of skill in the art would understand that the type of mechanical connection is not meant to be limiting, and that there are a plurality of mechanical connections that could be utilized, and would still fall within the scope of the present invention.

In at least some embodiments, the housing 4 comprises a window 5 for viewing the contents of the housing. In at least some embodiments, the handle 2 is connected to a skirt 3 to which the applicator tool is attached and which serves to stabilize the applicator tool.

The handle 2, the skirt 3, and the housing 4 may be made of any material, such as gold, silver, platinum, stainless steel or plastic. It is possible, but not necessary, that the handle 2, the skirt 3, and the housing 4 may all be made of the same material. In some embodiments, the handle 2 and the housing 4 are constructed of the same material but the skirt is constructed of a different material. In some embodiments, a single component of the case, such as the handle 2, the skirt 3, and the housing 4, may be constructed of more than one material. For example, in at least some embodiments of the invention, the window feature 5 of the housing 4 will be constructed of transparent glass or transparent plastic, or any other suitable transparent or translucent material, while the remainder of the housing may be constructed of metal, plastic or other materials. Many different combinations of materials are possible for use in constructing the outer components of the case and are not meant to be limiting to the scope of the present invention.

Figure 2:
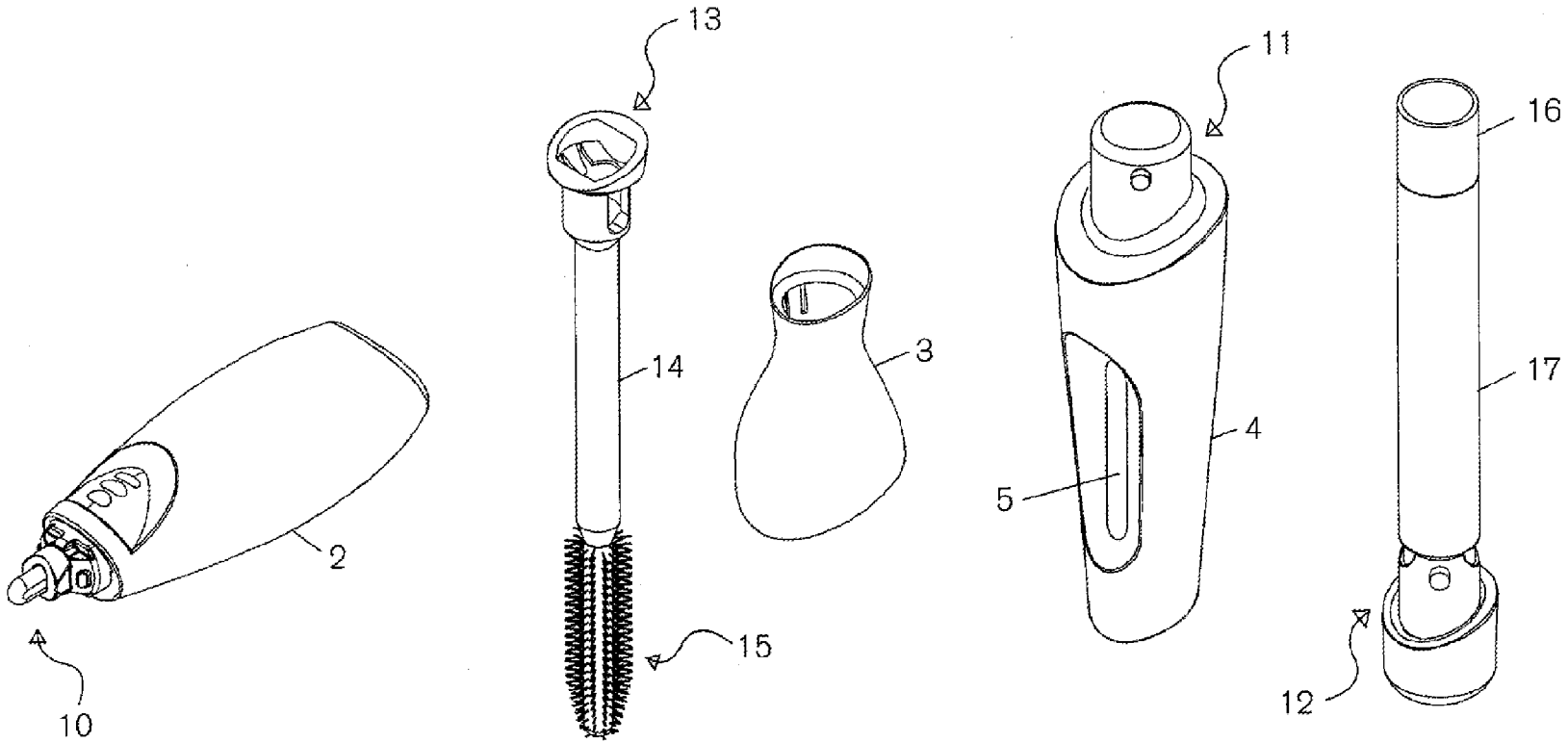
FIG. 2 shows a view of one embodiment of the components of the invention, disassembled.

In FIG. 2, the components of the invention as they exist in some embodiments are shown. The handle 2 comprises a connecting mechanism 10 that enables connection of the handle to the applicator tool 14. The connecting means 10 of the handle 2 connects directly with the connecting means 13 of the applicator tool 14. The connecting means could be any mechanical means for connecting the handle to the applicator tool in a secure way so that the handle can be held when a user wishes to apply the content of the case using the applicator tool. For example, the connecting means may be, but is not limited to, a screwing mechanism, a snapping mechanism, a magnetic mechanism, a twist-lock mechanism, or a locking mechanism. In some embodiments, the connecting means is a snap-lock mechanism such as the one depicted in FIG. 2.

The applicator end 15 of the exchangeable applicator tool 14 may be any tool that is useful in applying the substance contained in the case. For example, the applicator end 15 of the applicator tool 14 may be, but is not limited to, a straight brush, a curved brush, a sponge, a pad, a cotton swab or a comb. As depicted in FIG. 2, the applicator end 15 of the applicator tool 14 is a straight brush. In some embodiments, the brush may be a straight brush, a curved or angled brush, a brush with a larger diameter at a first end than a second end (so that the brush tapers toward the free end and away from the applicator tool stem), or any combination thereof.

As noted with regard to FIG. 1, in at least some embodiments, the handle 2 is connected to a skirt 3. The handle 2, the skirt 3, and the applicator tool 14 are all joined by connecting means such as those depicted in FIG. 2. Examples of mechanical connecting devices are depicted in FIG. 2 at 10, 13 and at the top inside section of 3. In some embodiments, the applicator tool 14 connects directly to the handle 2, with the skirt 3 connecting to the handle 2. In some embodiments, the applicator tool 14 connects directly to the skirt 3, with the skirt 3 connecting to the handle 2. One of ordinary skill in the art realizes that any suitable mechanism may be used to connect together the handle 2, the skirt 3, and the applicator tool 14. So long as the applicator tool is removable and replaceable by another applicator tool, such connecting mechanisms fall under the scope of the invention.

In some embodiments of the invention, there is no skirt 3. Rather, there may be a handle similar to that shown in FIG. 1 and, for example, an applicator tool with a mechanism for connecting the applicator tool to either the cartridge or the housing. In some embodiments of the invention, the handle 2 and the skirt 3 will be combined into a single integrated handle (which may be referred to as simply a "handle") that contains a mechanism for connecting the exchangeable applicator tool to the integrated handle and a mechanism for connecting the integrated handle to the housing 4.

FIG. 2 depicts the housing 4, including the window 5 for viewing the contents of the case. In at least some embodiments, an exchangeable cartridge 17 fits inside the housing 4 so that the defining upper edge of the cartridge 17 is flush, or even, with the defining upper edge of the housing 4. A connecting means 12 is used to removably attach the cartridge 17 to the housing 4. The connecting means could be any mechanical means for connecting the housing to the cartridge so that the cartridge is held securely in place within the housing for storage and use. For example, the connecting means may be, but is not limited to, a screwing mechanism, a snapping mechanism, a 90° twist-lock mechanism, a locking mechanism, or any combination of connecting means. In some embodiments, the connecting means is a snap-lock mechanism such as the one depicted in FIG. 2.

Figure 3:
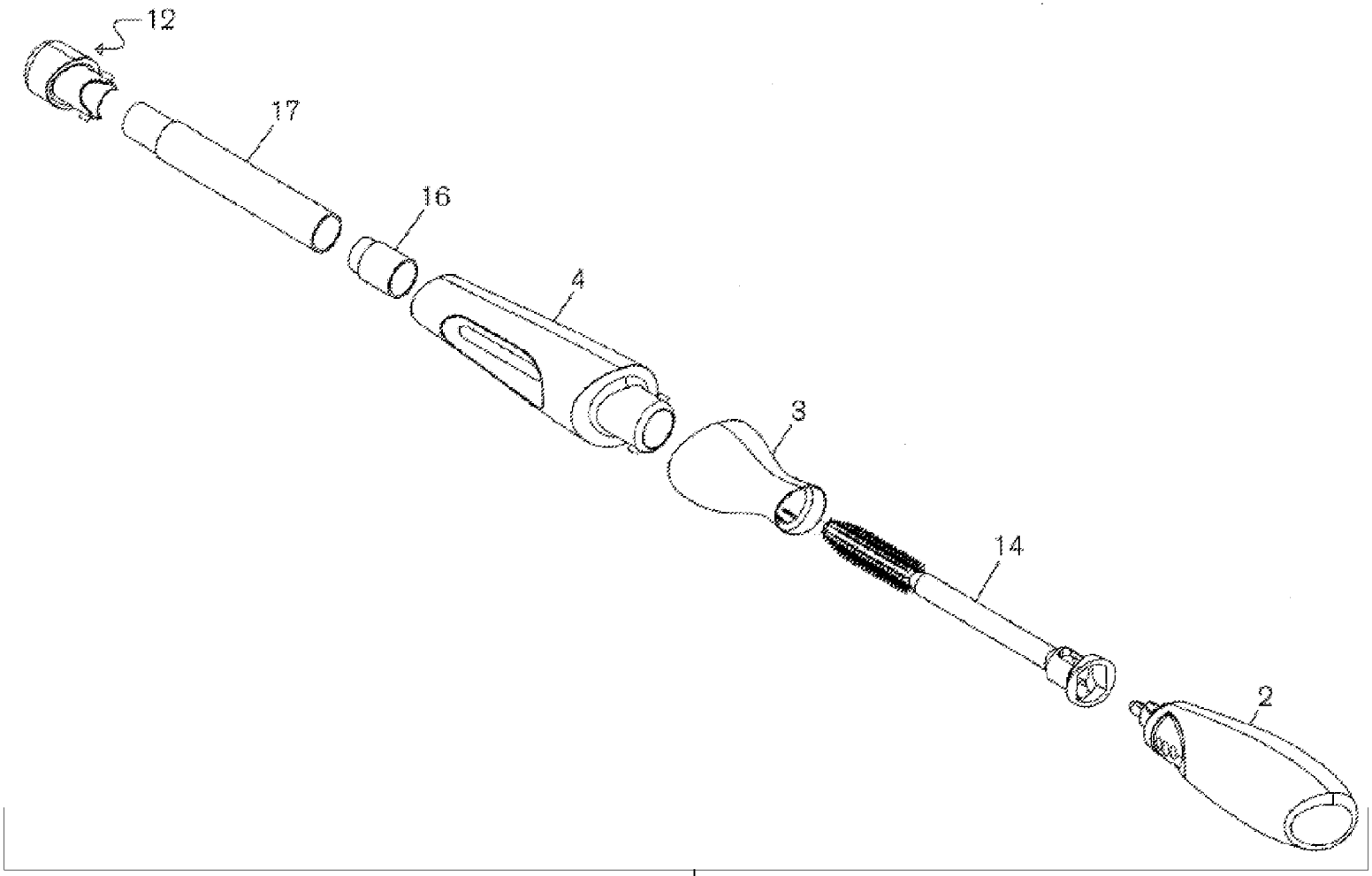
FIG. 3 shows an exploded view of one embodiment of the invention.

FIG. 3 depicts an "exploded" view of an embodiment of the invention, with the components arranged in the order in which they fit together in a fully assembled, closed case. The handle 2 removably attaches to the applicator tool 14. The handle 2 and the applicator tool 14 are attached so that the applicator tool 14 can be removed and replaced whenever the user wishes to do so. In the embodiment depicted in FIG. 3, the handle 2 and the applicator tool 14 are attached by a snap-lock connector, but any mechanical connector could be used so long as the applicator tool 14 can be removed and replaced. Examples of mechanical connectors include screw connectors, snap-lock connectors, twist-lock connectors, magnetic connectors and any other connectors that can serve to removably attach a first component to a second component. The connected handle 2 and applicator tool 14 are attached to the skirt 3. In the embodiment depicted in FIG. 3, the skirt is removably attached so that it serves to stabilize the applicator tool 14 for use.

The housing 4 contains a cavity for receiving a cartridge 17 with a cavity for use in containing a substance to be applied by the applicator tool 14. The cartridge 17 is removable and replaceable. The cartridge 17 is removably connected to the housing 4 and is at least partially held in place by a bottom connector 12. In the embodiment depicted in FIG. 3, the removable connection is achieved via the bottom connector 12 that is shown here to be a snap-lock mechanism, but any mechanical connector could be used as long as the cartridge 17 can be removed and replaced.

In the embodiment depicted in FIG. 3, the cartridge 17 is further stabilized by an assembly cap 16. The assembly cap 16 serves to hold the cartridge in place within the housing 4, and also serves to make the top edge of the cartridge 17 flush with the top edge of the housing 4. This feature serves to keep the housing 4 free of the substance contained in the cartridge 17 by preventing build-up of the substance contained in the cartridge 17 around the top of the housing 4. In some embodiments, the assembly cap 16 is not present, but rather the cartridge itself will fit inside the housing 4 so that the top edge of the cartridge 17 is flush with the top edge of the housing 4.

In at least some embodiments, the applicator end of the applicator tool 14 will fit snugly through the neck of the assembly cap 16 (or of the cartridge itself, in the absence of an assembly cap 16), thus wiping excess substance off of the applicator tool and further protecting the housing 4 from being soiled by the substance in the cartridge 17. Contamination of the housing 4 with the substance from the cartridge 17 is undesirable. It is an objective of at least some embodiments of the invention that no substance be left on the case when a first cartridge is removed and replaced with a second cartridge, as the substance in the second cartridge might be contaminated with the substance from the first cartridge. As noted above, in some embodiments, a single component comprises the cartridge 17 and the assembly cap 16 so that the same objective is accomplished.

Figure 4:
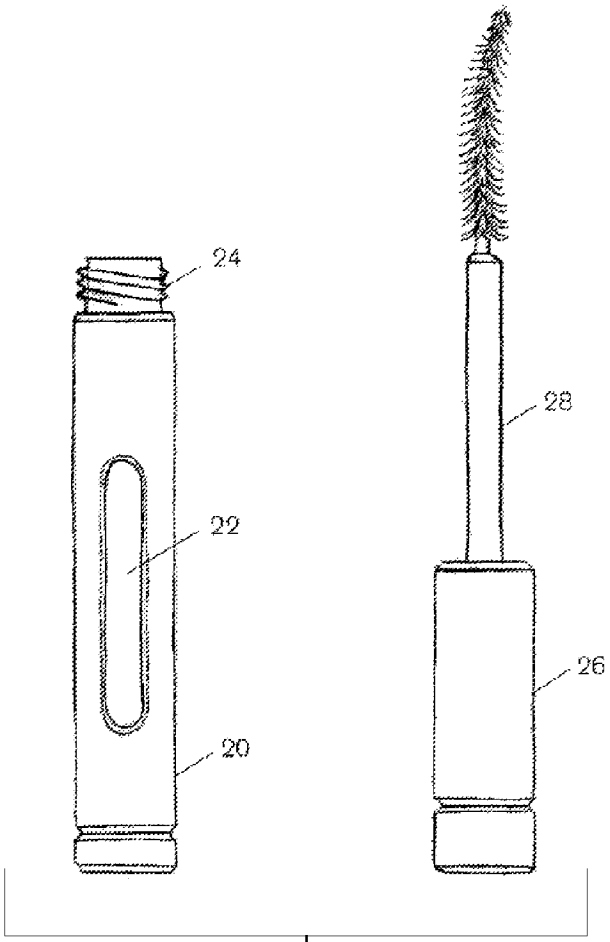
FIG. 4 shows a view of one embodiment of the invention when fully assembled and closed.

FIG. 4 depicts an embodiment of the invention with a screw connector. The housing 20 comprises a window 22 for viewing the contents of the cartridge which is inside the housing, and screw threads 24 for removably connecting the housing 20 to the handle 26, which is removably attached to the applicator tool 28.

Figure 5:
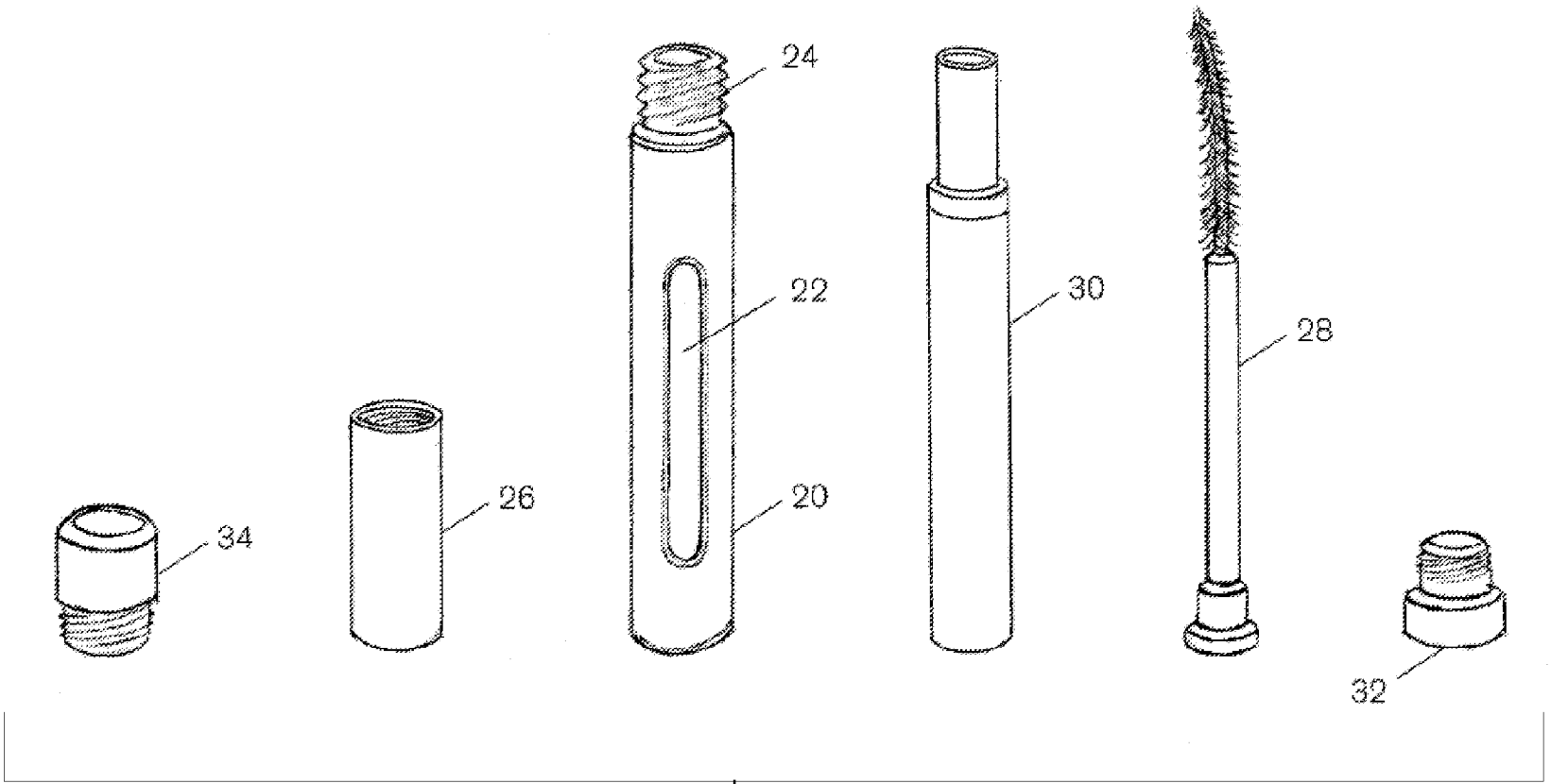
FIG. 5 shows components of one embodiment of the invention, disassembled.

FIG. 5 depicts the same embodiment of the invention as depicted in FIG. 4, with the components further disassembled. The housing 20 comprises a window 22 for viewing the contents of the cartridge 30. The cartridge 30 is held in place inside the housing 20 by placing the cartridge 30 inside the housing 20 and screwing a bottom connector 32 into the bottom of the housing 20, thus holding the cartridge 30 inside the housing 20.

Still referring to FIG. 5, and as in the embodiment described in FIG. 3, the defining upper edge of the cartridge 30 fits flush with the defining upper edge of the housing 20. This feature serves to keep the housing 20 free of the substance contained in the cartridge 30 by preventing build-up of the substance contained in the cartridge 30 around the top of the housing 20 and/or around the top of the cartridge 30. In at least some embodiments, the tool end of the applicator tool 28 will fit snugly through the neck of the cartridge 30, thus wiping excess substance off of the applicator tool and further protecting the housing 20 from being soiled by the substance in the cartridge 30.

The handle 26 holds the applicator tool 28 by use of a screw connector, wherein the applicator tool 28 has a lip on the end opposite the end containing the tool, and the lip is situated on a ledge inside the handle. A cover 34 is then screwed into the top of the handle 26, thus removably connecting the applicator tool 28 to the handle 26 in a way that enables storage of the applicator tool within the cartridge and also enables maneuverability of the applicator tool for use in applying the substance.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other changes, combinations, omissions, modifications and substitutions, in addition to those set forth in the above paragraphs, are possible. Those skilled in the art will appreciate that various adaptations and modifications of the just described embodiments can be configured without departing from the scope and spirit of the invention. Therefore, it is to be understood that, within the scope of the appended claims, the invention may be practiced other than as specifically described herein.

What is claimed is:

1. A case for a substance that is applied by an applicator tool, comprising:

a housing comprising a mechanical connection and an opening on a first end, the opening adapted to receive an exchangeable cartridge having a cavity for use in containing a substance; and a handle configured to removably attach directly to the mechanical connection of the housing, and comprising a connecting means adapted to removably attach to an exchangeable applicator tool with an applicator end for use in applying the substance;

the exchangeable cartridge; and the exchangeable applicator tool, wherein the applicator end of the exchangeable applicator tool is configured to be inserted into the cavity of the exchangeable cartridge when the case is in a closed position.

2. The case of claim 1, wherein the housing comprises a window for viewing the cavity of the exchangeable cartridge.

3. The case of claim 1, wherein a defining upper edge of the exchangeable cartridge is flush with a defining upper edge of the housing at the first end when the exchangeable cartridge is removably attached to the housing.

4. The case of claim 1, wherein the applicator end of the exchangeable applicator tool is selected from the group consisting of a brush, a comb, a pad, a cotton swab and a sponge.

5. The case of claim 4, wherein the applicator end is a brush selected from the group consisting of a straight brush, a curved brush, an angled brush, and a brush of larger diameter at a first end of the brush than at a second end of the brush.

6. The case of claim 1, wherein the exchangeable cartridge is recyclable.

7. The case of claim 1, wherein the exchangeable applicator tool is recyclable.

8. The case of claim 1 wherein the exchangeable applicator tool is washable.

9. The case of claim 1 further comprising a skirt.

10. The case of claim 1 further comprising a removable cover for the exchangeable cartridge.

11. A method of replacing an exchangeable cartridge in a case for a substance, comprising:

providing a case comprising:

a housing comprising a mechanical connection and an opening on a first end, the opening adapted to receive an exchangeable cartridge and a handle configured to removably attach directly to the mechanical connection and comprising a connecting means adapted to removably attach to an exchangeable applicator tool, wherein the housing and the handle are removably attached directly to one another using the mechanical connection when the case is in a closed position;

an exchangeable cartridge removably inserted into the housing at the first end of the housing; and an exchangeable applicator tool removably attached to the handle by the connecting means;

removing the exchangeable cartridge from the housing; and removably attaching a second exchangeable cartridge to the housing.

12. The method of claim 11, wherein the removably attaching is accomplished by a mechanical connector.

13. The method of claim 12, wherein the mechanical connector is selected from the group consisting of a screw connector, a snap, a twist-lock connector, and a snap-lock connector.

14. A method of replacing an exchangeable applicator tool in a case for a substance, comprising:

providing a case comprising:

a housing comprising a mechanical connection and an opening on a first end, the opening adapted to receive an exchangeable cartridge and a handle configured to removably attach directly to the mechanical connection and comprising a connecting means adapted to removably attach to an exchangeable applicator tool, wherein the housing and the handle are removably attached directly to one another using the mechanical connection when the case is in a closed position;

an exchangeable cartridge removably inserted into the housing at the first end of the housing; and an exchangeable applicator tool removably attached to the handle by the connecting means;

removing the exchangeable applicator tool from the handle; and removably attaching a second exchangeable applicator tool to the handle.

15. The method of claim 14, wherein the removably attaching is accomplished by a mechanical connector.

16. The method of claim 15, wherein the mechanical connector is selected from the group consisting of a screw connector, a snap, a twist-lock connector, and a snap-lock connector.

17. A method of manufacturing a case for containing a substance that is applied by an applicator tool, comprising:

providing a housing comprising a mechanical connection and an opening on a first end, the opening adapted to receive an exchangeable cartridge with a cavity for use in containing a substance;

providing a handle configured to removably attach directly to the mechanical connection of the housing and comprising a connecting means adapted to removably attach to an exchangeable applicator tool with an applicator end for use in applying the substance;

providing the exchangeable cartridge;

providing the exchangeable applicator tool, wherein the applicator end of the exchangeable applicator tool is inserted into the cavity of the exchangeable cartridge when the case is in a closed position; and manufacturing the case by attaching the housing directly to the handle using the mechanical connection.

* * * * *